US005261674A

United States Patent [19]

Allison

[11] Patent Number: 5,261,674

[45] Date of Patent: Nov. 16, 1993

[54] ROLLING TARGET WITH LAUNCHER

[76] Inventor: Andrew J. Allison, 735 Cole Dr., Golden, Colo. 80401

[21] Appl. No.: 935,273

[22] Filed: Aug. 26, 1992

[51] Int. Cl.[5] ..... F41J 9/02

[52] U.S. Cl. ..... 273/359; 124/1; 273/407

[58] Field of Search ..... 273/359, 407; 124/1

[56] References Cited

U.S. PATENT DOCUMENTS 5,087,053 2/1992 Head ..... 273/359

*Primary Examiner*—William H. Grieb

*Attorney, Agent, or Firm*—Rick Martin

[57] ABSTRACT

A rolling target is made from a heavy duty industrial hose material. The rolling target comprises a target mount, target, and a rim having an angular momentum after 4 mph is obtained that creates a gyroscopic stability to withstand most hits from bullets of a gun. A portable launcher for multiple rolling targets is actuated by a rope pull.

13 Claims, 5 Drawing Sheets

ROLLING TARGET WITH LAUNCHER

FIELD OF INVENTION

The present invention relates to a rolling target on a hill and a launcher that allows multiple targets to be launched in sequence.

BACKGROUND OF THE INVENTION

In target shooting a gun is most commonly fired at a target that is either stationary or moving.

It should be noted that stationary targets usually cannot move except for the pop-up targets used in the military and police training agencies where the movement is instantaneous to raise a specific target. The operation of such an apparatus is expensive.

It should also be noted that there are two basic types of moving targets: clay pigeons and moving objects in shooting galleries. The clay pigeon is limited to movement in the air which is controlled by the launcher, gravity and the winds. When hit they are not reusable. The shooting gallery has a moving target most commonly seen as knock-down ducks. They are limited for use by 22 caliber rifles or smaller guns and to the distance, speed, and movement controlled by the expensive chain and motor apparatus that is necessary for operation. Further, any target can only be hit once during its pass by.

The present invention improves the art of moving targets by allowing movement, fast or slow, to be possible for a desired time. It also improves the present moving targets by allowing more unpredictable movement on the ground and continuous use after one or more hits while in motion. The rolling ground target is light enough for easy transportation and yet sturdy enough to withstand objects that may be encountered while in motion over the ground. This gives unpredictability of motion creating a more realistic and competitive target to shoot at. Thus, this invention opens up a new competition for gun enthusiasts. In such a competition the portable launcher for multiple target release could be of use as a means to give the shooter more scorable shots.

SUMMARY OF THE INVENTION

The primary object of the present invention is to provide a rolling target capable of movement along the ground that can withstand most hits by most guns while in motion between 4 and 20 mph.

Another object of the present invention is to provide a reusable moving target apparatus that allows numerous shots to be fired at it while in motion.

Another object of the present invention is to allow more than a single rolling ground target to be launched by a portable launcher.

A final object of the present invention is to provide a new means of moving target competition for gun enthusiasts.

Other objects of this invention will appear from the following description and appended claims, referenced being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
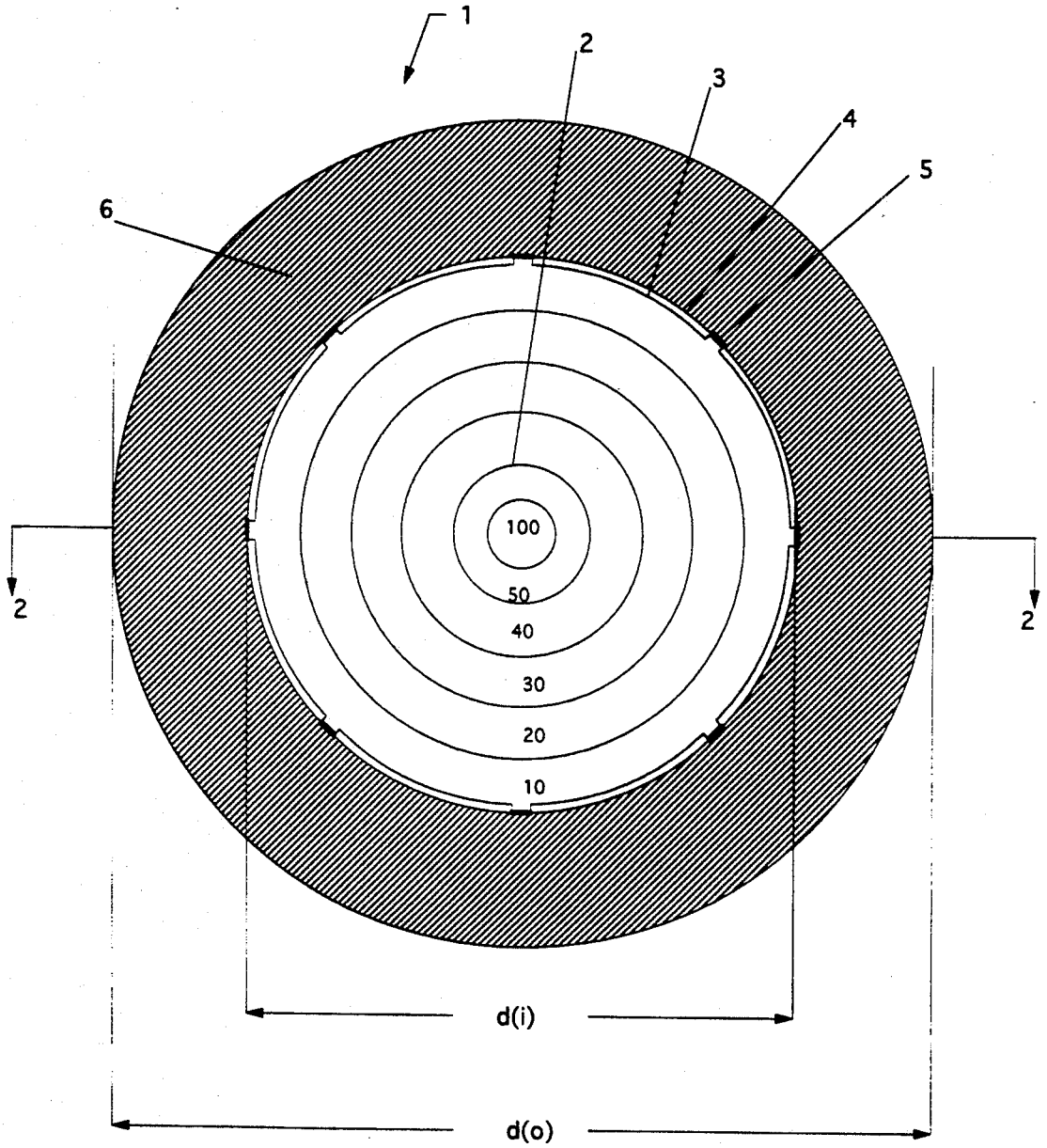
FIG. 1 is a front plan view of the rolling ground target with a typical bull's eye target mounted.

FIG. 1 shows a rolling ground target 1 with a typical bull's eye target 2 mounted on a cardboard target mount 3 which is affixed to the inner target rim 4. d(i) is approximately eight inches in diameter. d(o) is approximately 12 inches in diameter. The cardboard target mount 3 is mounted by staples 5, but many mounting means are suitable including push rivets.

Figure 2:
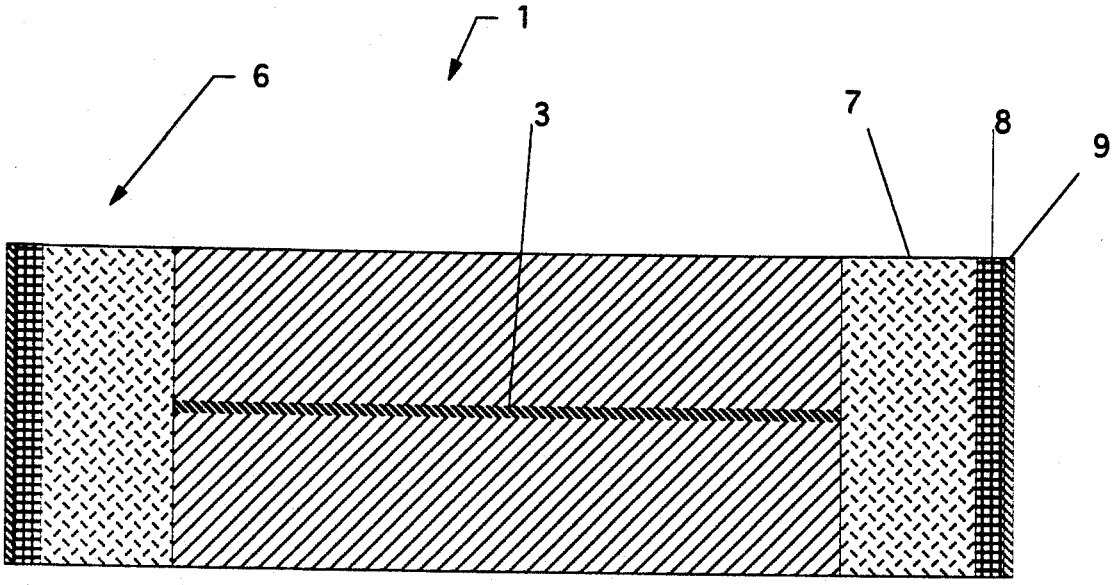
FIG. 2 is a cross sectional view of the rolling ground target taken along line 2—2 of FIG. 1.

Referring to FIG. 2, a cross section of the rolling target 1 shows the heavy duty industrial hose construction of rim 6. The rim 6 comprises a thick layer of rubber 7, with steel tire cord 8 and covered by a thick plastic coating 9. Rim 6 should absorb a significant amount of the impact energy of the bullet to prevent ricochet (the process of a bullet fired rebounding toward the shooter.)

Figure 3:
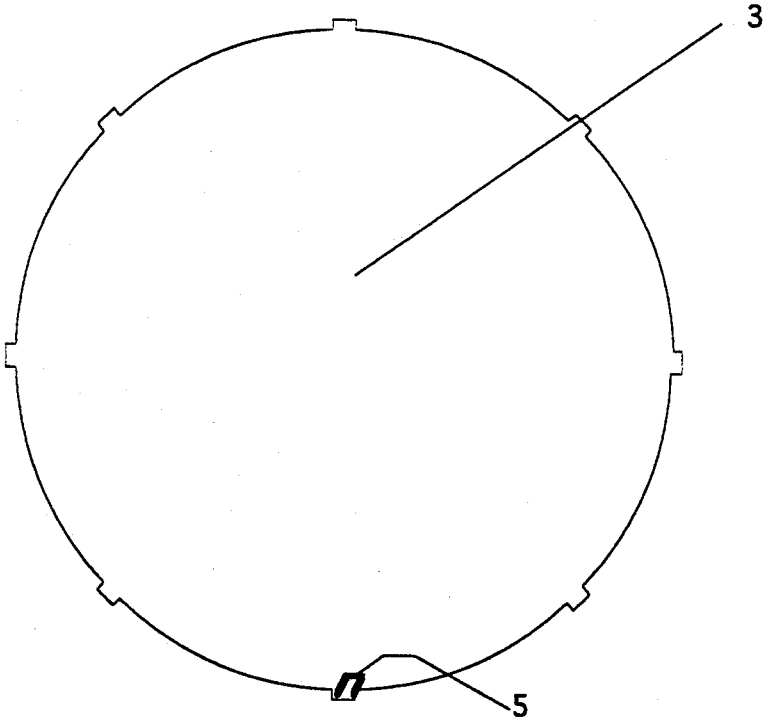
FIG. 3 is a front plan view of a cardboard target mount cut to fit into the rolling ground target of FIG. 1.

FIG. 3 shows cardboard target mount 3, that is mounted inside the rim 6 on the inner target rim 4 by staples 5. The cardboard target mount 3 can comprise any penetrable material including plastic, metal, wood and composite materials. The target 2 can be affixed to target mount 3 by any suitable means including glue or staples (not shown). A typical rim 6 is 3 inches wide (d(o)−d(i)) and 3 inches thick, from front to back. d(i) is typically 12, 16 and 24 inches. A 12 inch model weighs 5 pounds (2.268 kg). A 16 inch model weighs 8 pounds (3.629 kg). A 24 inch model weighs 11 pounds (5 kg).

Figure 4:
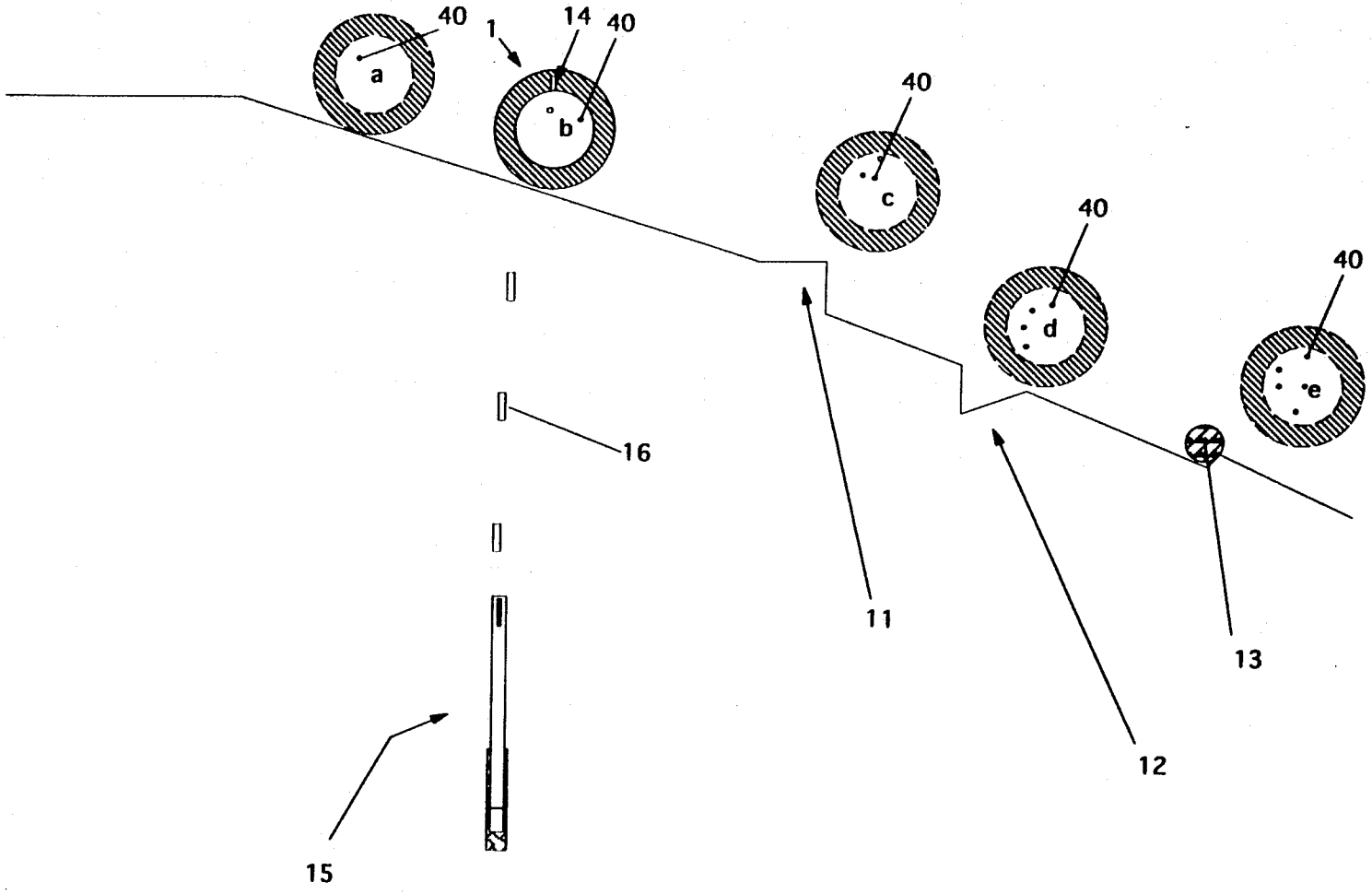
FIG. 4 is a top perspective view of a rolling ground target moving down a typical hill.

In FIG. 4 the rolling target 1 is put into motion (a–e) on a hill where it could acquire speeds ranging from 4–20 mph. At position a, at an approximate speed of 4 mph, enough angular momentum is created to allow the rolling ground target to continue rolling upright over rocks 11, ditches 12, or similar objects like a log 13. Further, numerous hits 40 from a gun 15 as the rolling target moves from a–e are non effective to the target's motion because the target mount 3 (FIG. 1) offers no resistance.

The angular moment of the rim 6 has a mass approximately 2.268 kg. This creates a gyroscopic stability that can be related to an impact energy 14 of a projectile 16 from a gun 15. Using principles of a cylindrical shell rolling, an expert knowledgeable in this field can create the relationship with the correct assumptions leaving reasonable error. If the impact energy 14 is equal to or greater than the gyroscopic stability (mvr/2), the rolling target will not fall over. Thus, with an impact energy 14 of approximately 600 ft-lbs (0.813 kgms) the created gyroscopic stability (mvr/2) is large enough to allow direct hits from a bullet 16 to the upper most edge of the rim 6. The rolling target will continue in motion (a-e) on the hill.

Wherein:

m=2,268 g v=10 mph (4.5 m/s)

r=5 inches (0.127 m, r is the distance from the center of the target 1 FIG. 1 to the middle of the rim 6)

In this example (mvr/2)=1.296 kgms and the impact energy 14 is 0.813 kgms.

Figure 5:
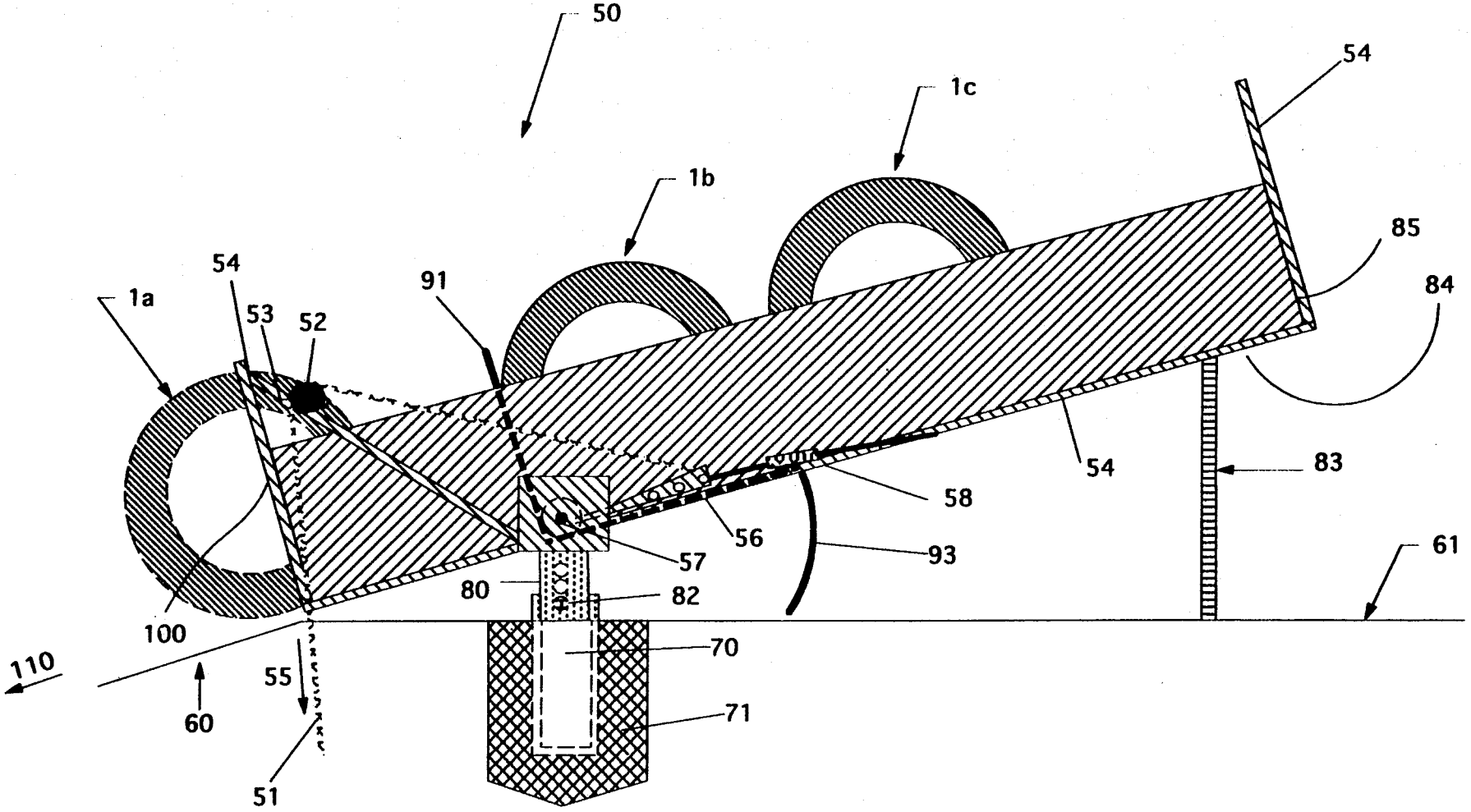
FIG. 5 is a side plan view of the multiple target launcher.
Figure 6:
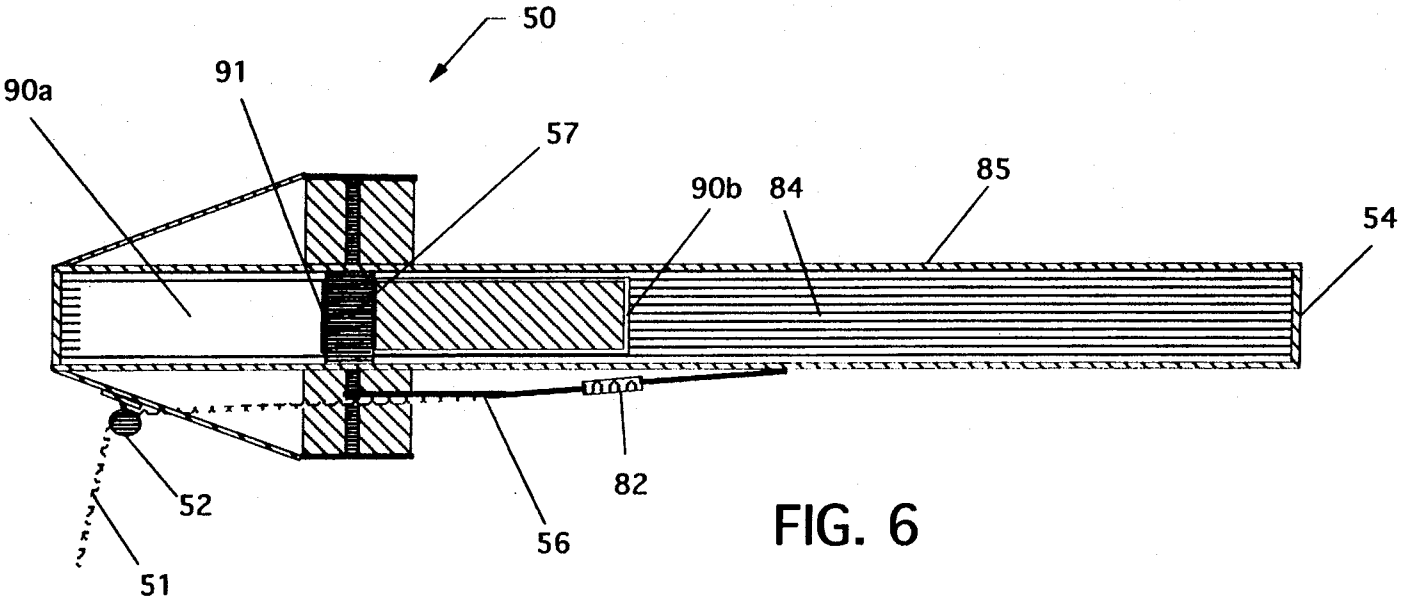
FIG. 6 is a top plan view of the multiple target launcher.

FIG. 5 shows a multiple rolling target launcher 50. One person (not shown) that is not shooting gives a quick pull 55 on the rope 51. The rope 51 works through a pulley 52 mounted to a steel plate 53 connected to frame 54. One inch angle iron is suitable for frame 54. Once the rope 51 is pulled 55, a lever 56, connected to the roller 57, launches a rolling target 1*a* onto the sloped ground 60 through the open end 100. This launching process gives the rolling target 1*a* enough velocity, as seen in FIG. 4—position a, to be stable for competition. After rolling target 1*a* is launched in direction 110, a spring 58 attached to lever 56 pulls launcher 50 back into the ready position.

At each launch site for competition 61 a launch site pipe 70 (plastic, steel, etc.) is set in concrete base 71 at distances 50 ft, 75 ft, 100 ft, etc.. The rolling target launcher 50 has a pipe 80 (plastic steel, etc.) small enough to fit snug (no movement of launcher if touched) into the launch site pipe 70. The desired height of the launcher 50 from the ground can be determined by height holes 82 in the launcher pipe 80. A simple brace 83 is attached to the floor 84 of the launcher 50 for stability. All walls 85 and floors 84 of the launcher 50 are suitably made of ½" plywood bolted (not shown) to frame 54.

In FIG. 5, 6, 7 is shown the roller 57 that the rope 51 turns to launch each rolling target 1*a*, 1*b*, 1*c*. The holes 90*a*, 90*b* in the floor 84, are for the two arms 91, 92 to pass through as the roller 57 is turned for the launching arm mechanism 95 to work.

Figure 7:
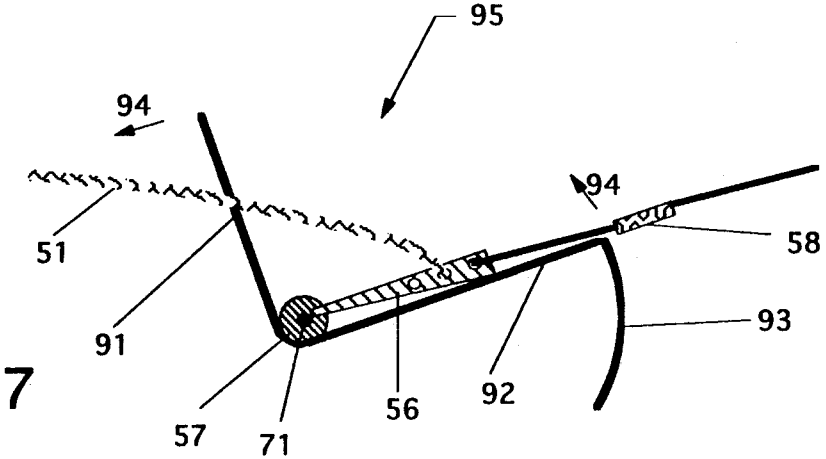
FIG. 7 is a side plan view of the launching arm mechanism housed inside the walls of FIG. 5 to control the launching of each rolling ground target.

In FIG. 7 the launching arm mechanism 95 comprises a rope 51 connected to the steel lever 56 connected to the roller 57, pivot 71, arms 91, 92. As the launching arm mechanism 95 launches in direction 110 (FIG. 5) the next rolling target 1*b* (FIG. 5) is restrained from jamming the launching arm mechanism or falling through the floor hole 90*b* by a radial piece 93 welded to the plate 92.

I claim:

1. A rolling target comprising:

a cylindrical rim having an inside diameter;

a target mount;

said cylindrical rim further comprising a mass m>2 kg, a velocity v>4 MPH, and a radius r>0.127 meter;

means for mounting the target mount to the inside diameter of the cylindrical rim;

a target;

means for mounting said target on said target mount;

said rim further comprising a gyroscopic stability (mvr/2) greater than the momentum of a bullet;

said cylindrical rim further comprising a solid resilient material, thereby preventing ricochet; and said target mount further comprising a sheet of penetrable material.

2. The rolling target of claim 1, wherein said resilient material further comprises reinforced rubber hose.

3. The rolling target of claim 1, wherein said penetrable material further comprises cardboard.

4. The rolling target of claim 1, wherein said target comprises a sheet of penetrable material.

5. The rolling target of claim 4, wherein said penetrable material further comprises paper.

6. The rolling target of claim 1, wherein said means for mounting said target on said target mount further comprises glue.

7. The rolling target of claim 1, wherein said means for mounting said target mount to the inside diameter of the cylindrical rim further comprises staples.

8. A target launcher for propelling cylindrical targets comprising:

a rectangular box having a front and a rear and an open top;

said rectangular box further comprising a bottom;

said bottom further comprising a storage capacity for a plurality of cylindrical targets stacked serially and upright;

said bottom further comprising a slot at the front;

said rectangular box further comprising means for supporting the rear above the front;

a launching mechanism centrally mounted above said slot;

said launching mechanism further comprising a cradle for launching said cylindrical targets;

said cradle further comprising a neutral position and means for pivoting forward, thereby propelling said cylindrical targets out the front of the rectangular box one at a time;

said cradle further comprising a restraint member to prevent more than one cylindrical target at a time from entering said cradle; and said cradle further comprising a forward rotational travel through said slot and spring means to return to said neutral position.

9. The target, launcher of claim 8, wherein said launching mechanism further comprises means for remote actuation.

10. The target launcher of claim 9, wherein said means for remote actuation further comprises a rope affixed to said cradle, whereby pulling the rope pivots the cradle forward, thereby propelling the cylindrical target out the front of the rectangular box.

11. The target launcher of claim 10, wherein said cradle further comprises a forward arm, a rearward arm, a radial restrainer downwardly projecting from said rearward arm, and said rope is affixed to said rearward arm, thereby lifting said rearward arm and radial restrainer while lowering said forward arm.

12. The target launcher of claim 8, further comprising means for mounting said rectangular box at adjustable heights above the ground.

13. A cylindrical target and a launcher for launching cylindrical targets on a rolling trajectory comprising:

said cylindrical target further comprising a cylindrical rim having an inside diameter;

a target mount;

said cylindrical rim further comprising a mass m>2 kg, a velocity v>4 MPH, and a radius r>0.127 meter;

means for mounting the target mount to the inside diameter of the cylindrical rim;

a target;

means for mounting said target on said target mount;

said rim further comprising a gyroscopic stability (mvr/2) greater than the momentum of a bullet;

said cylindrical rim further comprising a solid resilient material, thereby preventing ricochet;

said target mount further comprising a sheet of penetrable material;

said launcher further comprising a rectangular box having a front and a rear and an open top;

said rectangular box further comprising a bottom;

said bottom further comprising a storage capacity for a plurality of cylindrical targets stacked serially and upright;

said bottom further comprising a slot at the front;

said rectangular box further comprising means for supporting the rear above the front;

a launching mechanism centrally mounted above said slot;

said launching mechanism further comprising a cradle for launching said cylindrical targets;

said cradle further comprising a neutral position and means for pivoting forward, thereby propelling said cylindrical targets out the front of the rectangular box one at a time;

said cradle further comprising a restraint member to prevent more than one cylindrical target at a time from entering said cradle; and said cradle further comprising a forward rotational travel through said slot and spring means to return to said neutral position.

* * * * *